US006079615A

United States Patent [19]

Irvin et al.

[11] Patent Number: 6,079,615

[45] Date of Patent: Jun. 27, 2000

[54] MAILER ASSEMBLY

[75] Inventors: Robert Irvin, Roanoke; Anthony B. Dolce, Troutville, both of Va.

[73] Assignee: AmeriComm Direct Marketing, Inc., Roanoke, Va.

[21] Appl. No.: 09/082,809

[22] Filed: May 21, 1998

[51] Int. Cl.[7] ..... B65D 27/00

[52] U.S. Cl. ..... 229/92.1; 229/69; 229/305; 229/313

[58] Field of Search ..... 229/92.1, 92.3, 229/69, 301, 304, 305, 313, 316

[56] References Cited

U.S. PATENT DOCUMENTS

| | | | |
|---|---|---|---|
| 3,184,150 | 5/1965 | Hubbard | 229/305 |
| 4,239,114 | 12/1980 | Denay | 229/69 X |
| 4,346,916 | 8/1982 | Shelton | 229/69 X |
| 4,625,909 | 12/1986 | Ferrando | 229/92.1 |
| 4,754,915 | 7/1988 | Steidinger | 229/69 X |
| 4,860,946 | 8/1989 | Braud | 229/69 |
| 5,104,036 | 4/1992 | Rutkowski et al. | 229/301 |
| 5,125,562 | 6/1992 | Bendel | 229/301 X |
| 5,452,851 | 9/1995 | Albert et al. | 229/305 X |
| 5,501,392 | 3/1996 | Kraus | 229/92.1 X |
| 5,553,774 | 9/1996 | Goodno | 229/305 X |

FOREIGN PATENT DOCUMENTS

| | | | |
|---|---|---|---|
| 5139449 | 6/1993 | Japan | 229/301 |

*Primary Examiner*—Jes F. Pascua
*Attorney, Agent, or Firm*—Mintz, Levin, Cohn, Ferris, Glovsky and Popeo, P.C.

[57] ABSTRACT

The mailer assembly is used for direct mail applications. Upon removal of tear strips at each side of the mailer assembly, an insert is formed from a panel secured within the mailer which is able to fall free of the mailer. The mailer assembly may be provided with two or more panels to form two or more free inserts. In one embodiment, the mailer assembly may be constructed with a return envelope into which a free insert may be folded and stuffed.

15 Claims, 1 Drawing Sheet

FIG. 1
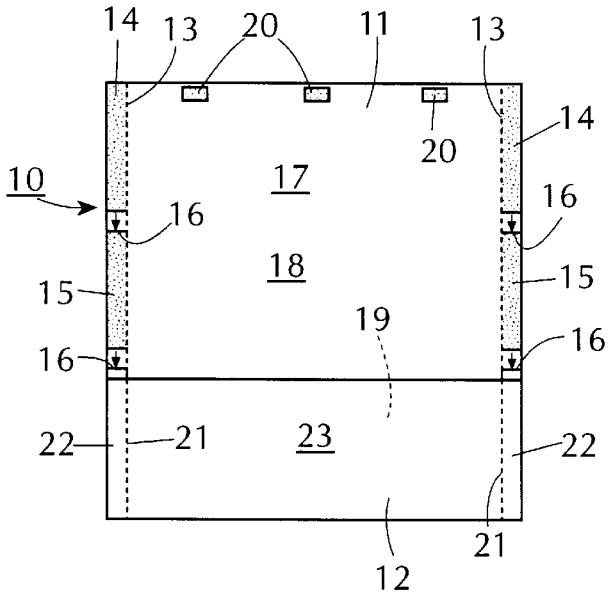
FIG. 2
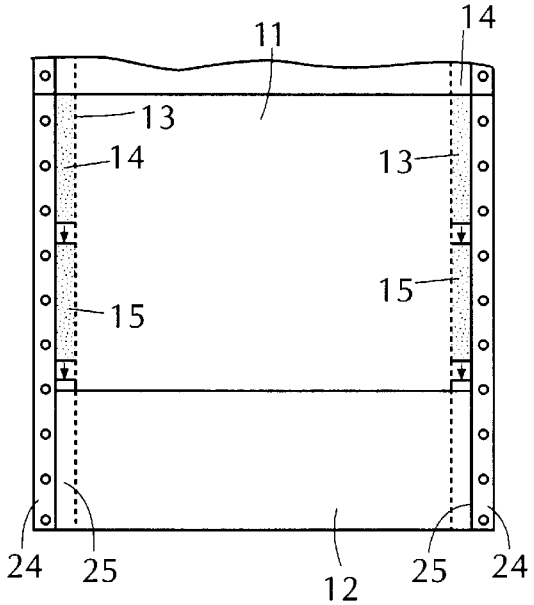
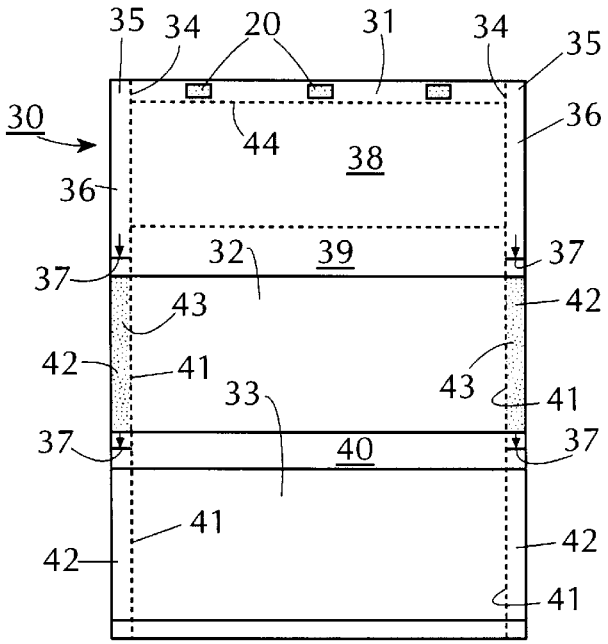
FIG. 3
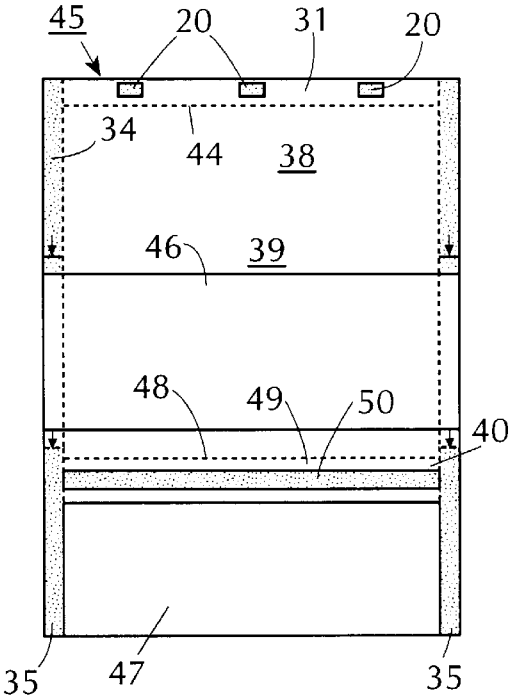
FIG. 4

MAILER ASSEMBLY

FIELD OF THE INVENTION

This invention relates to a mailer assembly. More particularly, this invention relates to a mailer assembly for direct mail and/or promotional applications.

BACKGROUND OF THE INVENTION

As is known, mailer assemblies for direct mail applications have been constructed in various types of manners particularly to provide a surface on which to provide a message while also being foldable to form an envelope for mailing purposes. U.S. Pat. No. 4,951,864 describes a particular one piece mailer formed of a one piece blank which can be imaged, for example in a laser printer, folded, and, at the same time, sealed with glue along the edges to form a mailer. In addition, in order to provide for easy opening of the sealed mailer, lines of weakening are provided along the longitudinal edges of the blank so that the two side edges of the mailer can be stripped away to permit the remainder of the mailer to be opened for reading purposes.

In many cases, a direct mail mailer assembly is provided with a tear-off portion which is to be removed by a recipient, for example the tear-off portion may be in the form of a check, an order form for ordering magazines or merchandise, or a form for returning information to the original sender. However, such direct mail mailer assemblies require the recipient to physically remove the tear-off portion.

It is an object of the invention to provide an improvement on the previously known mailer assembly described in U.S. Pat. No. 4,951,864.

It is another object of the invention to provide a mailer assembly with one or more free inserts.

It is another object of the invention to provide a direct mail mailer assembly which is recipient friendly.

It is another object of the invention to provide a direct mail mailer assembly which has an insert which is able to fall free when the mailer assembly is opened without need to physically remove the insert.

SUMMARY OF THE INVENTION

Briefly, the invention provides a mailer assembly which includes a one piece blank and at least one panel disposed transversely over the blank. The blank is of rectangular shape with a pair of parallel lines of weakening, each of which defines a tear-off strip along a longitudinal edge of the blank. The blank also has an adhesive on each tear off strip and is foldable transversely of the tear-off strips to permit securement of facing portions of the blank together to form a mailer for outgoing mail purposes.

The panel is adhesively secured on opposite sides to the respective tear-off strips of the blank and has a pair of parallel lines of weakening coincident with the lines of weakening of the blank in order to define tear-strips therein and to form an insert in the mailer.

The mailer assembly may be processed in a laser printer or on any other suitable type of imaging machine so that information, such as customized information, may be recorded not only on the portions of the blank but also on the panel which is secured across the blank. The mailer assembly may also be preprinted as in a printing press prior to adding customized information.

When a mailer is received in the mail by a recipient, the tear strips along the two side edges of the mailer are removed in a conventional fashion so that the remainder of mailer blank can be folded out into a readable condition. At this time, the removal of the tear strips of the blank also serves to remove the tear strips of the panel. As a result, a free insert is formed by the remainder of the panel and is able to fall free. This free insert may then be used by the recipient in various manners.

The mailer assembly is particularly useful for direct mail and/or promotional purposes. As is known, one of the features of a direct mail mailer is to have a recipient become involved in the opening of the mailer. Whereas previous mailers required the recipient to tear off a portion of the mailer for return mail purposes or any other purpose, the present mailer assembly allows the insert to fall free without a need for a physical tearing out of the insert. As such, the mailer assembly is recipient friendly. The insert may be in the form of a check, a coupon which entitles a recipient to a discount when ordering merchandise, magazines or the like, or a form to be returned to the original sender.

The one piece blank may be sized and provided with fold line indicia to delineate folding of the blank into two, three or more folded portions. By way of example, the blank may be C-folded or Z-folded or folded in any other manner customary in the trade.

The panel may be disposed over an end portion of the blank or over an intermediate portion of the blank. Further, the mailer assembly may be provided with two or more panels.

If there are two or more panels on a blank, the panel falling on an alternate portion of the blank, that is whether in the center portion or at an opposite end portion, is provided with adhesive on the tear-off strips so that during the folding and sealing process, the mailer is completely sealed.

In another embodiment having a pair of panels secured over a blank, one of the panels may be used to form a return envelope. In this embodiment, the second panel is disposed transversely over an end portion of the blank and is adhesively secured along three edges to the blank within the tear-strips of the blank in order to define a pocket for a return envelope. In addition, the blank is provided with a transverse line of perforations to separate the return envelope from the remainder of the blank as well as with a fold line to define a sealing flap for the return envelope. In addition, a suitable adhesive such as a remoistable glue is provided on the flap in order to adhere over the second panel to close the pocket for return mail purposes.

BRIEF DESCRIPTION OF THE DRAWINGS

These and other objects and advantages of the invention will become more apparent from the following detailed description taken in conjunction with the accompanying drawings wherein:

FIG. 1 illustrates a front view of a mailer assembly constructed in accordance with the invention;

FIG. 2 illustrates a view of a portion of a continuous mailer assembly in accordance with this invention;

FIG. 3 illustrates a modified mailer assembly constructed in accordance with this invention having two panels for forming two free inserts; and FIG. 4 illustrates a front view of a mailer assembly constructed in accordance with the invention having a return mail envelope and a panel for forming a free insert.

DESCRIPTION OF THE PREFERRED EMBODIMENTS

Referring to FIG. 1, the mailer assembly 10 includes a one-piece cut sheet blank 11 of rectangular shape and a panel 12 disposed transversely over the blank 11.

The blank 11 has a pair of parallel lines of weakening 13, each of which is disposed inwardly of a longitudinal edge in order to define a tear-off strip 14 along the longitudinal edge of the blank 11. The blank 11 also has an adhesive 15 on each tear-off strip 14 which may be of a remoistenable type or a pressure sensitive type.

In addition, the blank 11 is provided with fold line indicia 16 on each tear-off strip 14 to delineate the folding of the blank 11 into three overlying portions 17, 18, 19. Each fold line indicia 16 may be formed simply of a horizontal line, as viewed, with the designation "FOLD" and an arrow adjacent the printed line. When folded, the bottom portion 19 folds over the central portion 18 and the top portion 17 folds over the back of the bottom portion 19. This effect is a C-fold. Alternatively, the blank 11 may be Z-folded with the end portions 17, 19 folded over opposite sides of the central portion 18. In this case, adhesive 15 is placed on the back side of one end portion rather than on the front side as shown in FIG. 1 for sealing purposes. Also, a line of glue or glue dots may be applied along a transverse edge of the panel 23 for sealing purposes.

The blank 11 is also provided with an adhesive in the form of adhesive blocks 20 along the upper transverse edge in order to effect complete sealing of the end portions 17, 19 of the blank 11 together in overlying relation or along the upper and lower transverse edges for a Z-fold arrangement.

The panel 12 is disposed over the lower portion 19 of the blank 11 and is adhesively secured on opposite sides to the tear-off strips 14 of the blank 11. In addition, the panel 12 has a pair of parallel lines of weakening 21 coincident with the lines of weakening 13 of the blank 11 in order to define tear-strips 22 and to form an insert 23 within the tear strips 22.

From a constructional view point, after the mailer assembly 10 has been imaged and/or preprinted with information on the exposed portions 17, 18 of the blank 11 and the insert 23, the mailer assembly 10 is folded into three overlying positions. At this time, the blank portion 19 carrying the panel 12 is folded to the inside in overlying relation to the intermediate portion 18 and sealed to the intermediate portion 18 via the adhesive 15. The upper portion 19 is then folded over the back side of the bottom portion 19 and sealed thereto via the adhesive 15 on the two sides of the top portion 17 and the adhesive blocks 26 along the transverse edge of the top portion 17. The folded and sealed mailer assembly may then be processed in the mail.

When received, a recipient removes the tear-off strips 14, 22 along the two sides of the mailer assembly in order to permit folding out of the remainder of the blank 11. At the same time, as the tear-off strips 22 of the panel 12 are also removed simultaneously with the tear-off strips 14 of the blank 11, the insert 23 is able to fall free of the remainder of the blank 11.

From a use standpoint, the insert 23 may be preprinted in the form of a coupon which entities the recipient to a rebate when purchasing merchandise in a retail outlet or the like or may be a check which entitles the recipient to a rebate upon purchasing merchandise in a magazine or the like.

Since the insert 23 falls free of the mailer when opened, there is no need for the recipient to tear out the insert 23. As a result, the mailer assembly 10 is rather user friendly.

By providing a free insert, the mailer provides a more effective direct mail format and one which is able to attract the attention of the recipient.

Referring to FIG. 2, wherein like reference characters indicate like parts as above, a continuous mailer assembly may be formed of a plurality of blanks 11. In this case, each blank 11 includes a pair of pin-hole strips 24, each of which is removably secured via a line of weakening 25 to the blank 11 adjacent a respective tear-off strip 14. In this form, the mailer assembly 10 is but one unit of a multi-unit continuous assembly which can be fed through an imaging device via the pin-hole strips 24 and subsequently separated from the remaining assemblies 11 (not shown) of the continuous assembly.

Referring to FIG. 3, wherein like reference characters indicate like parts as above, the mailer assembly 30 is formed of a one piece blank 31 and a pair of panels 32, 33 disposed transversely over the blank 31. In this embodiment, the one piece blank 31 has a pair of parallel lines of weakening 34 to define tear-off strips 35 along the two longitudinal edges of the blank 30 with a suitable adhesive 36 provided on each tear off strip 35 for sealing purposes. The blank 30 is also provided with fold line indicia 37 similar to that described in the embodiment of FIG. 1 for folding of the blank 30 into three overlying portions 38, 39, 40. A suitable adhesive in the form of adhesive blocks 20 are provided along the upper transverse edge of the blank 31 to effect sealing of the facing portions together when folded.

Each panel 32, 33 is adhesively secured on opposite sides to the tear-off strips 35 of the blank 31 in a manner as described above. In addition, lines of weakening 41 are provided in each panel 32, 33 which are coincident with the lines of weakening 34 in the tear-off strips of the blank 31 to define tear-off strips 42. As indicated, one panel 32 is disposed over the intermediate portion 40 of the blank 31 while the second panel 33 is disposed over the bottom portion of the blank 30.

As shown in FIG. 3, the intermediate panel 32 has adhesive 43 on the tear strips 42 in order to secure the adjacent panels of the blank 31 together when the portions 38, 39, 40 are disposed over each other in overlying relation. Alternatively, adhesive may be applied to the tear strips 42 of the lower panel 33, as viewed, or to both panels 32, 33 to effect sealing of the mailer portions 38, 39, 40 together.

After the mailer assembly 30 has been processed, folded and mailed to a recipient, the recipient removes the tear-off strips 35, 42 along the two side edges of the mailer assembly and slides a finger under the sealed edge of the upper portion to permit folding out of the remainder of the mailer blank 31. At this time, the inserts defined by the two panels 32, 33 are allowed to fall free.

The blank 31 may also be provided with an additional line of weakening 44 in the upper portion of the blank 31 in order to define a tear-off strip on which the adhesive blocks 20 are provided for removal after opening of the mailer assembly.

In an alternative construction, the lower panel 33, as viewed, may be secured to the mailer portion 40 across the lower edge via a line or blocks of adhesive in order to ensure against any lifting away of the panel 33 from the mailer portion 40 during imaging in a laser printer. In this case, the blank 31 is initially made with a longer length, e.g. of a 12 inch length, with the panel 33 adhesively secured along the lower edge to the mailer portion 40. After imaging, the lower edge is cut off or chipped out prior to folding and sealing to remove the adhered parts thereby shortening the blank 31 to the move conventional length, e.g. an 11 inch length.

In still another alternative, the mailer assembly of FIG. 3 may use one long panel over the mailer portions 39, 40 instead of two short panels 32, 33 in order to provide one longer insert for promotional purposes.

Referring to FIG. 4, wherein like reference characters indicate like parts as above, the mailer assembly 45 is formed of a one piece blank 31 and a pair of panels 46, 47 in a manner to include a return envelope. As indicated, the first panel 46 is secured across an intermediate portion 39 of the blank 31 while the second panel 47 is disposed transversely over the blank 31 while being adhesively secured along the three edges to the lowermost portion 40 of the blank 31 within the tear-off strips 35 of the blank 31 in order to define a patch pocket. In addition, a transverse line of perforations 48 is provided above the panel 47 along with a fold line (not shown) parallel to the line of perforations 48 in order to define a sealing flap 49. A suitable adhesive 50, such as a remoistenable glue, is provided over the flap 49 to allow for sealing of the flap 49 over the panel 47 to close the pocket.

In this embodiment, the first panel 46 does not require adhesive along the side edges as the exposed adhesive on the tear-off strips 35 of the bottom portion 40 of the blank 31 serves to seal the mailer assembly when folded.

After a mailer assembly 45 has been imaged, sealed, mailed and opened, the return envelope formed by the panel 47, the remainder of the bottom portion 40 of the blank 31 and the flap 49 can be separated from the remainder of the blank 31 along the line of perforations 48. The return envelope may then be stuffed with any suitable materials, such as the insert from the first panel 46, in folded over condition, and the flap 49 folded over the panel of the return envelope for sealing purposes.

By way of example, the mailer assembly shown in FIG. 1 may be of a conventional size for a letter such as 8½ inches by 11 inches whereas the mailer assemblies of FIGS. 3 and 4 may be made of a larger size, such as 8½ inches by 14 inches. Also, by way of example, the return envelope incorporated within the embodiment of FIG. 4 may have a size when closed of about 7⅝ inches in width and 3½ inches in height.

Each of the above-described embodiments may be provided with a window as is known with or without a transparent patch over the window.

Further, the mailer assemblies of each of the embodiments may be supplied without any adhesive except, of course, for the adhesive used to secure the panels in place. In this case, the adhesive required for sealing the folded mailer may be applied before or during the folding operation.

What is claimed is:

1. A mailer assembly comprising a one-piece blank of rectangular shape having a pair of parallel lines of weakening, each line of weakening defining a tear-off strip along a longitudinal edge of said blank, said blank being foldable transversely of said tear-strips to permit securement of facing portions of said blank together to form a mailer; and at least one panel disposed transversely over said blank and being adhesively secured to said blank only along opposite sides to said respective tear-off strips of said blank, said panel having a pair of parallel lines of weakening coincident with said lines of weakening of said blank to define said tear-off strips therein and to form an insert in said mailer whereby, upon removal of said tear-off strips, said panel is detached from said blank.

2. A mailer assembly as set forth in claim 1 wherein each tear-off strip of said blank has fold line indicia to delineate folding of said blank into three overlying portions.

3. A mailer assembly as set forth in claim 2 wherein said panel is disposed over an end portion of said portions of said blank.

4. A mailer assembly as set forth in claim 2 wherein said panel is disposed over an intermediate portion of said portions of said blank.

5. A mailer assembly as set forth in claim 1 wherein said blank includes a pair of pin-hole strips, each pin-hole strip being removably secured to said blank adjacent a respective tear-off strip of said blank.

6. A mailer assembly as set forth in claim 1 wherein said blank has adhesive along each tear-off strip and along at least one transverse edge thereof to effect sealing of said facing portions together.

7. A mailer assembly as set forth in claim 1 comprising a pair of said panels disposed transversely over said blank and adhesively secured on opposite sides to said respective tear-off strips of said blank, each said panel having a pair of parallel lines of weakening coincident with said lines of weakening of said blank to define tear-strips therein and to form an insert in said mailer.

8. A mailer assembly as set forth in claim 7 wherein said blank has adhesive along each tear-off strip and along at least one transverse edge thereof to effect sealing of said facing portions together.

9. A mailer as set forth in claim 7 wherein each tear-off strip of said blank has fold line indicia to delineate folding of said blank into three overlying portions, each said panel being disposed over adjacent portions of said portion of said blank.

10. A mailer as set forth in claim 8 wherein at least one of said panels has adhesive on said tear strips thereof to secure said pair of panels in overlying relation.

11. A mailer as set forth in claim 10 wherein said blank has adhesive along each tear-off strip and along a transverse edge thereof to effect sealing of said facing portions together.

12. A mailer as set forth in claim 7, wherein said blank has one transverse line of weakening extending between said tear-off strips thereof to divide said blank into two portions.

13. A mailer as set forth in claim 1 further comprising a second panel disposed transversely over said blank and adhesively secured along three edges to said blank within said tear-off strips of said blank to define a pocket therewith.

14. A mailer as set forth in claim 13 wherein said blank further comprises a transverse line of perforations adjacent said second panel, a fold line parallel to said line of perforations to define a sealing flap and adhesive on said flap to adhere over said second panel to close said pocket.

15. A mailer as set forth in claim 14 wherein said one panel has adhesive on said tear-off strips to secure said portions of said blank in overlying relation.

* * * * *